US009757794B1

(12) United States Patent
Martirossian

(10) Patent No.: US 9,757,794 B1
(45) Date of Patent: Sep. 12, 2017

(54) MODULAR SPRUING ARRANGEMENT

(71) Applicant: Avak Martirossian, Cranston, RI (US)

(72) Inventor: Avak Martirossian, Cranston, RI (US)

( * ) Notice: Subject to any disclaimer, the term of this patent is extended or adjusted under 35 U.S.C. 154(b) by 0 days.

(21) Appl. No.: 15/443,778

(22) Filed: Feb. 27, 2017

(51) Int. Cl.
*B22C 9/08* (2006.01)
*B22C 9/04* (2006.01)

(52) U.S. Cl.
CPC ..... *B22C 9/082* (2013.01); *B22C 9/04* (2013.01); *B22C 9/046* (2013.01); *B22C 9/08* (2013.01)

(58) Field of Classification Search
CPC .. B22C 9/04; B22C 9/046; B22C 9/08; B22C 9/082
USPC ..... 164/18–24, 516–529
See application file for complete search history.

(56) References Cited

U.S. PATENT DOCUMENTS 4,340,107 A * 7/1982 Bauer ..... B22C 9/04 164/165
7,942,189 B1 * 5/2011 Quraishi ..... B22C 7/02 164/246
9,539,638 B2 * 1/2017 McGuire ..... B22C 9/04

FOREIGN PATENT DOCUMENTS

JP 60049832 A * 3/1985 ..... B22C 9/04

* cited by examiner

*Primary Examiner* — Kevin E Yoon

(57) ABSTRACT

A modular spruing system apparatus contains a base section, a main sprue cone, a center rod, a plurality of trunk sections, a plurality of arm sections, and an end cap. The main sprue cone is mounted onto the base section. The center rod centrally traverses through the base section and the main sprue cone so that the user can design a spruing tree of desired height. A center rod receiving hole of each of the plurality of trunk sections allows the center rod to traverse through the plurality of trunk sections when removably attached to each other. Next, the plurality of arm sections is attached to the plurality of branch sections. The plurality of arm sections can be fixed or removably attached to the plurality of branch sections. When the desired height is reached, the plurality of trunk sections is fastened together with the end cap.

13 Claims, 17 Drawing Sheets

MODULAR SPRUING ARRANGEMENT

FIELD OF THE INVENTION

The present invention relates generally to the field of jewelry casting. More specifically, the present invention addresses issues prevalent in treeing in the jewelry, medical, dental, and other high-volume production casting industries.

BACKGROUND OF THE INVENTION

A sprue is an appendage added to a wax part, which is used as the pathway to allow molten metal to flow into it. Even though spruing has been used for a considerable time, certain drawbacks of the process are yet to be accurately addressed.

Traditionally, treeing is manually completed by a selected individual who is sufficiently skilled to use the specialized tools involved in treeing. The need to have a skilled individual specifically for treeing can be disadvantageous in the lost wax casting industry. As an example, if a considerable number of parts are required within a limited time, the lack of resources can hinder the entire production process. Therefore, the efficiency in the process of treeing needs to be addressed.

Another disadvantage in traditional treeing methods is inconsistency. The inconsistency in treeing can lead to inconsistencies in the design which is a major disadvantage in any lost wax casting industry. Moreover, the inconsistencies in treeing can result in waste of material which is also financially disadvantageous.

The objective of the present invention is to address the aforementioned issues. In particular, the present invention expects to eliminate the need of special skills or tools to assemble a spruing tree. Thus, the casting cost and the time spent on assembling the tree is considerably reduced. Maximizing the quantities for each tree, increased efficiency, and minimum inconsistencies are among the many benefits that can be achieved by utilizing the present invention.

DETAIL DESCRIPTIONS OF THE INVENTION

Figure 1:
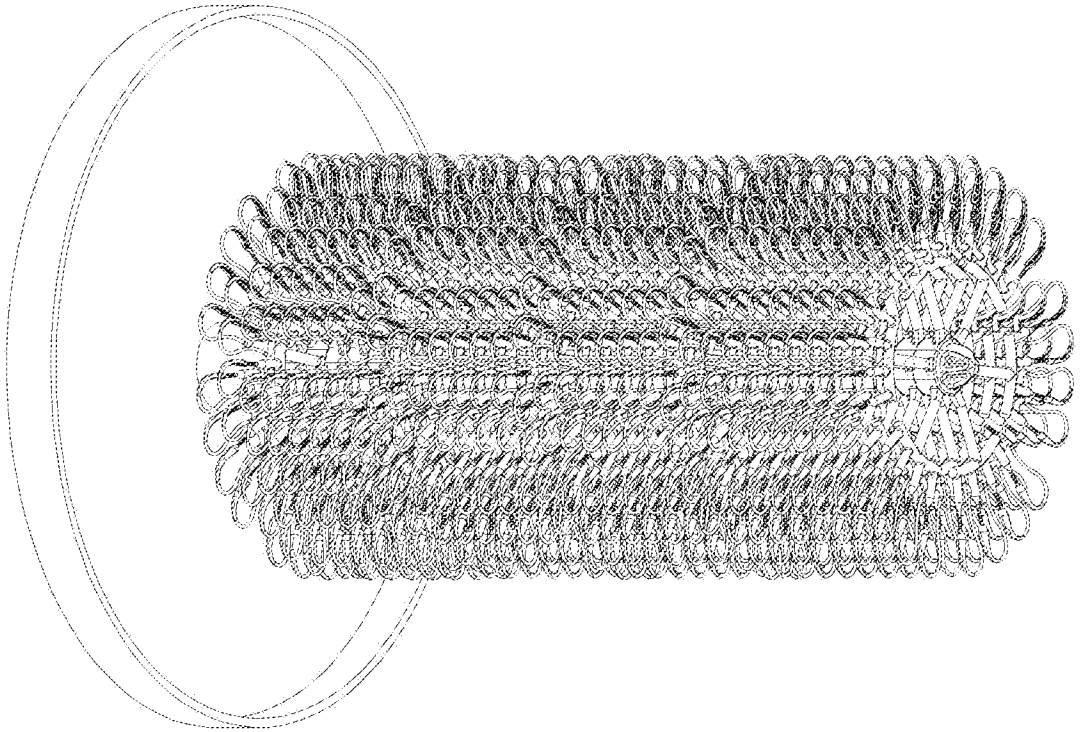
FIG. 1 is a perspective view of the present invention.
Figure 2:
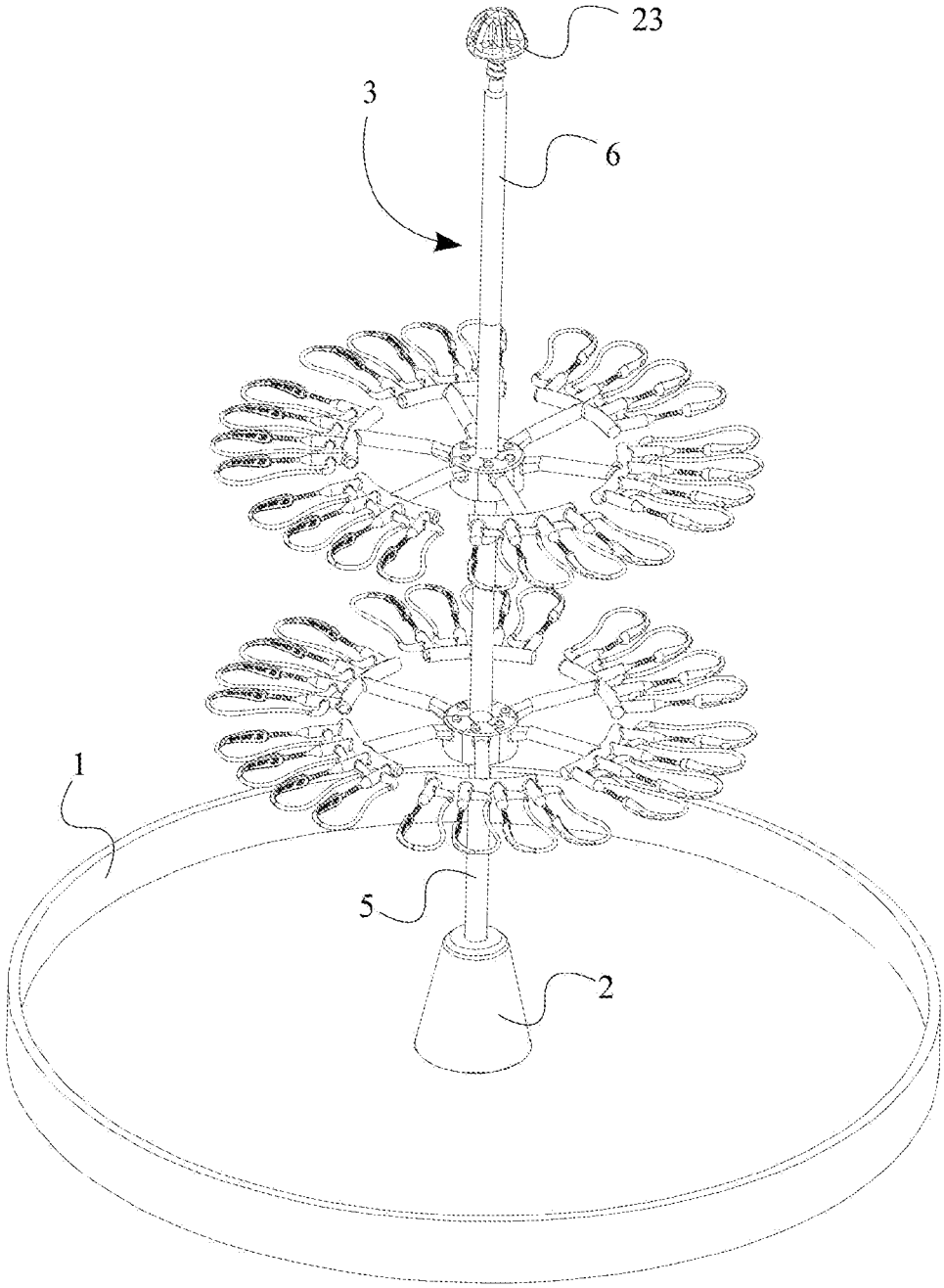
FIG. 2 is another perspective view of the present invention, wherein only two of the plurality of trunk sections are illustrated.

All illustrations of the drawings are for the purpose of describing selected versions of the present invention and are not intended to limit the scope of the present invention.

The present invention introduces a modular spruing system which allows for easy and rapid treeing of parts in precise, geometrically patterned increments. Issues such as the loss of wax during the casting process, the inconsistencies in treeing, and the need for a skilled individual for treeing is eliminated by utilizing the present invention.

As seen in FIGS. 1-8, the present invention comprises a base section 1, a main sprue cone 2, a center rod 3, a plurality of trunk sections 7, a plurality of arm sections 22, and an end cap 23. The base section 1 is used to stabilize the present invention on a surface. In the preferred embodiment of the present invention, the base section 1 is a threaded plastic base. However, the shape and size of the base section 1 can vary in different embodiments of the present invention. The main sprue cone 2, which is a conical component, is used to support the lower portion of the spruing tree. The spruing tree is constructed with the use of the plurality of trunk sections 7 eliminating the need for a traditional wax spruing tree. The center rod 3 is used to provide stability to the spruing tree. To do so, the center rod 3 is made from brass or other comparable material. The end cap 23 secures the plurality of trunk sections 7 along the center rod 3. The plurality of arm sections 22 is used to attach a desired pattern to the spruing assembly. Since the plurality of arm sections 22 is attached to predetermined positions, issues related to inconsistent spacing are solved through the present invention.

Figure 3:
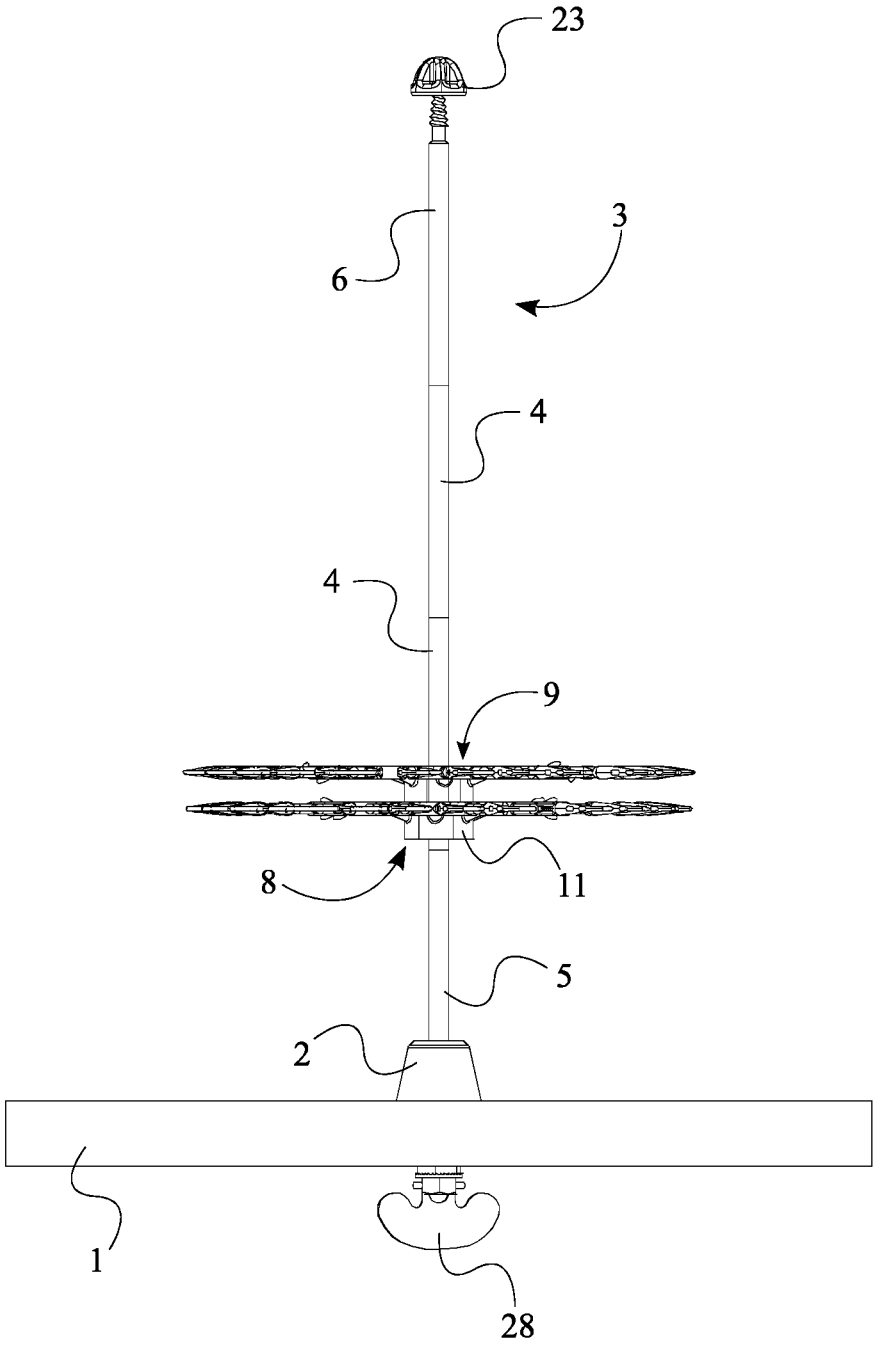
FIG. 3 is a side view of the present invention, wherein only two of the plurality of trunk sections are illustrated.
Figure 4:
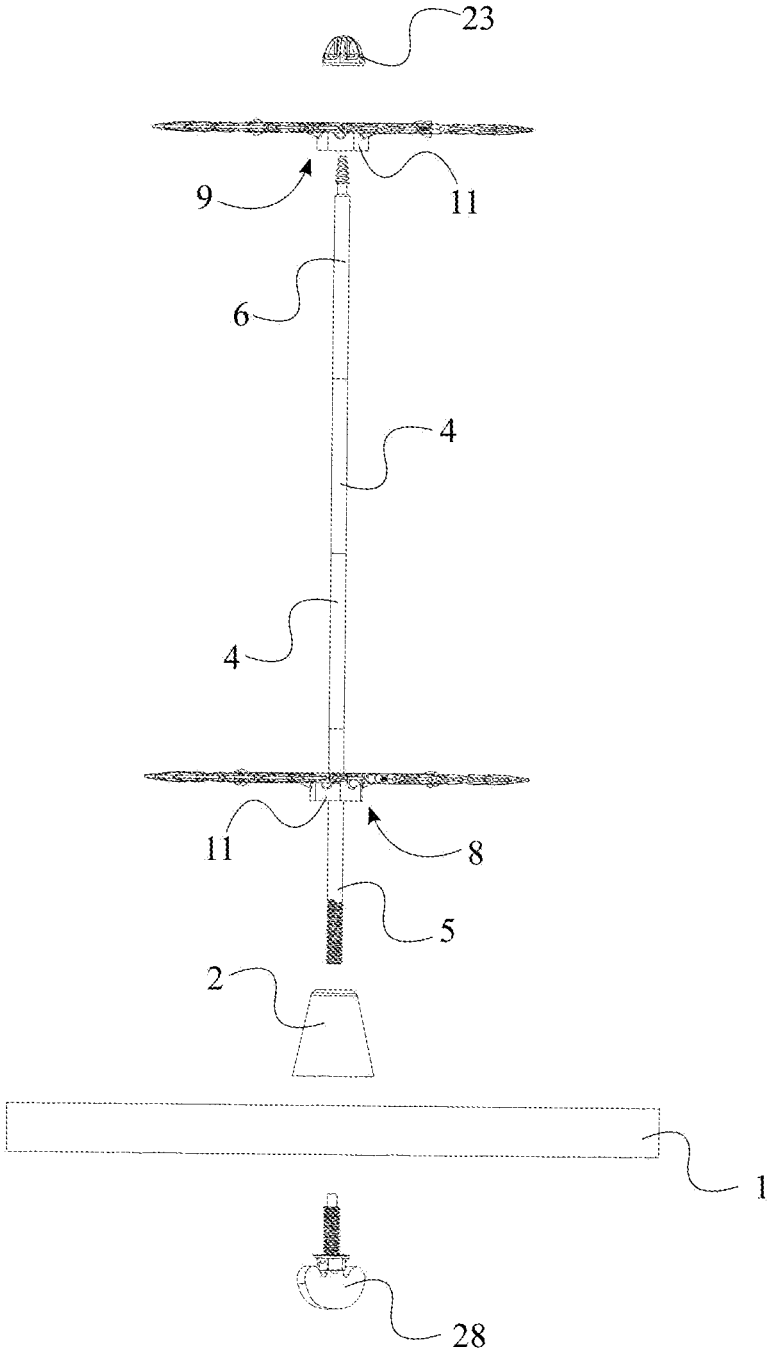
FIG. 4 is an exploded side view of the present invention, wherein only two of the plurality of trunk sections are illustrated.

As mentioned, the base section 1 is used to provide a steady platform for the spruing tree. To do so, the main sprue cone 2 and the plurality of trunk sections 7 need to be appropriately positioned. As illustrated in FIG. 3 and FIG. 4, the main sprue cone 2 is centrally positioned on the base section 1. In accordance with the main sprue cone 2, the plurality of trunk sections 7 is concentrically positioned adjacent to the main sprue cone 2 opposite to the base section 1. For the base section 1, the main sprue cone 2, and the plurality of trunk sections 7 to be held together, the center rod 3 traverses through the base section 1, the main sprue cone 2, and a center rod receiving hole 10 of each of the plurality of trunk sections 7.

Figure 5:
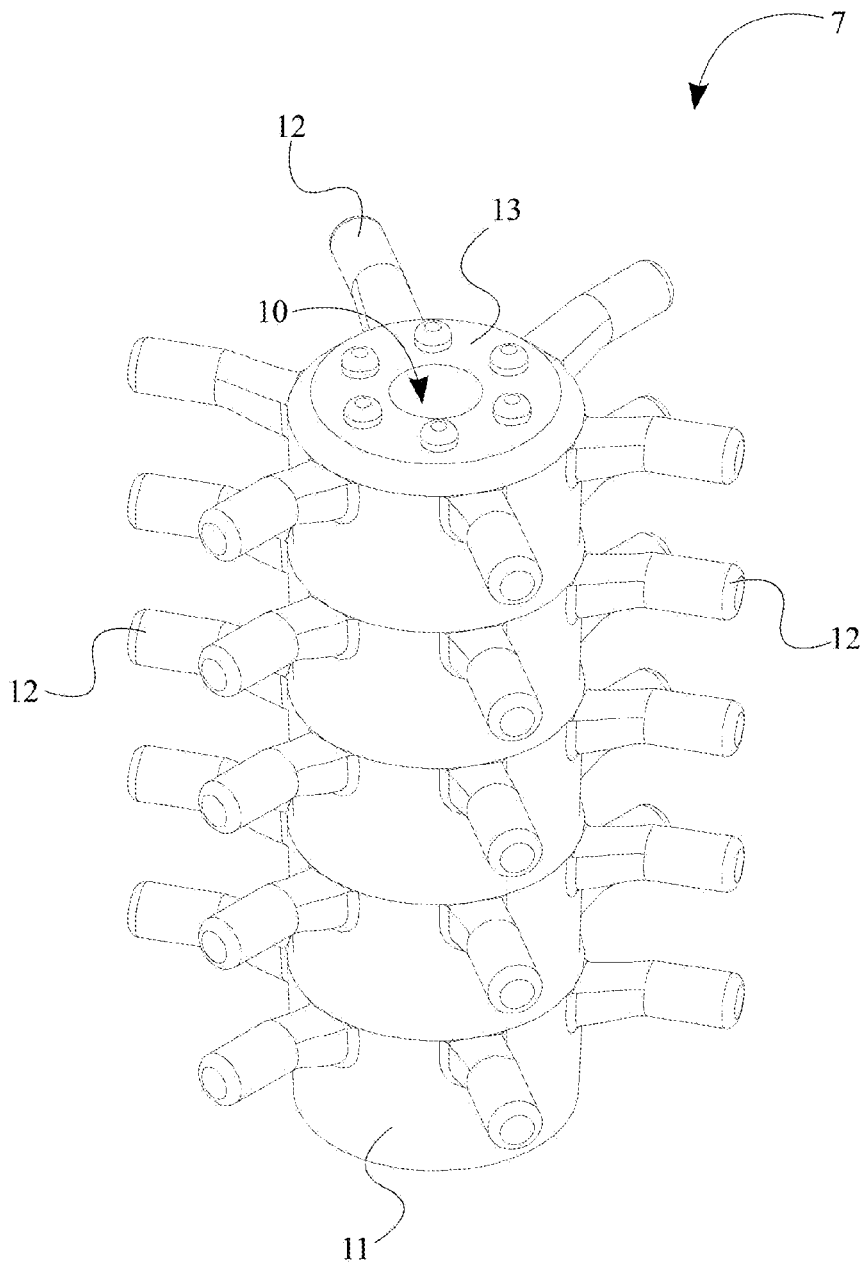
FIG. 5 is a perspective view of the plurality of trunk sections being removably attached to each other.
Figure 6:
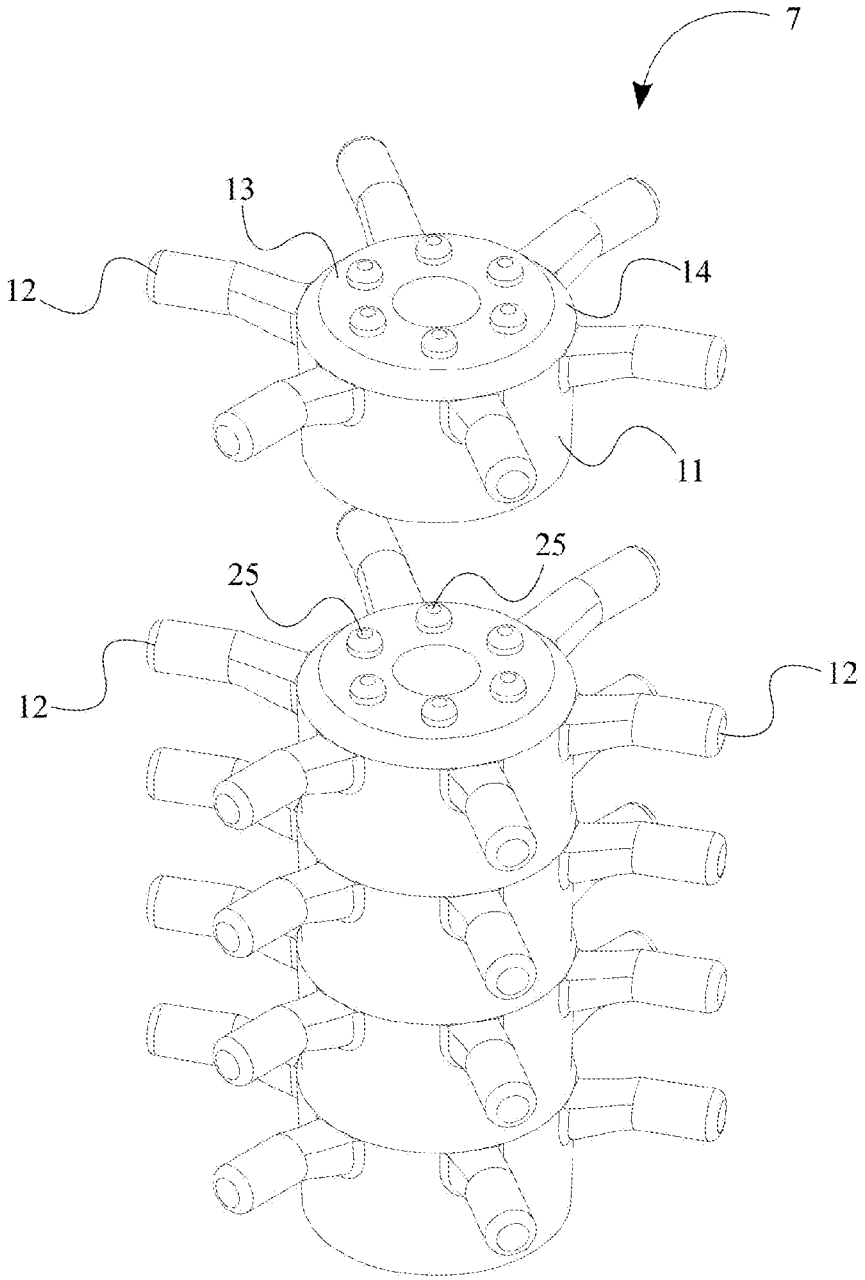
FIG. 6 is a perspective exploded view of the plurality of trunk sections being removably attached to each other.
Figure 7:
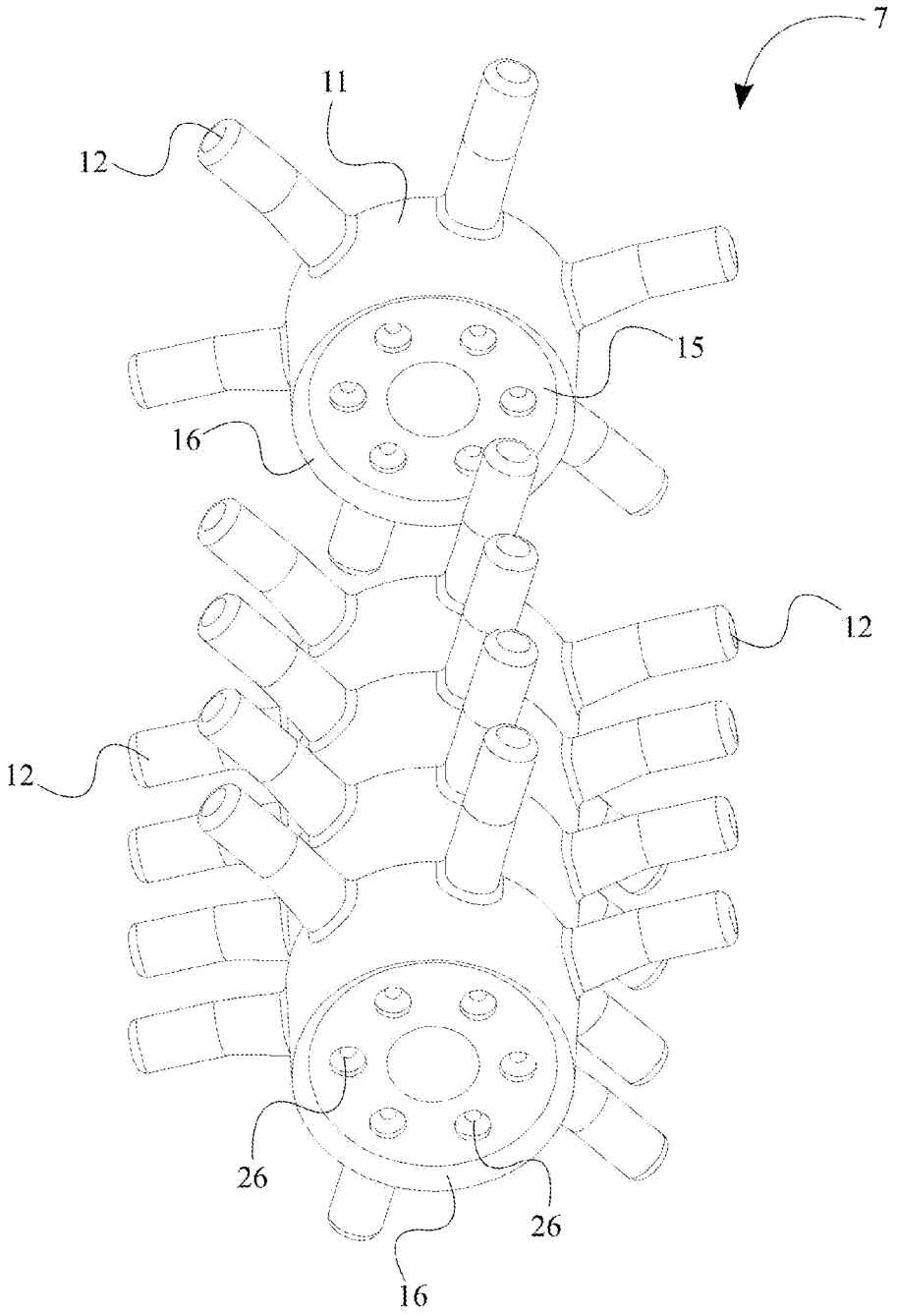
FIG. 7 is a bottom perspective view of the plurality of trunk sections being removably attached to each other.

In traditional spruing processes, the designs that need to be molded are manually inserted into the spruing tree. The tedious process can result in inconsistent spacing between each of the designs which can then lead to waste of metal and faulty designs. As seen in FIGS. 5-7, each of the plurality of trunk sections 7 are removably and concentrically attached to each other to create the spruing tree shown in FIG. 1. This not only allows the user to create a tree of a preferred height, but also results in increased efficiency. Each of the plurality of trunk sections 7 comprises a center rod receiving hole 10, a core portion 11, and a plurality of branch sections 12. The center rod receiving hole 10 centrally traverses through the core portion 11 which is circular in shape in the preferred embodiment of the present invention. The center rod receiving hole 10 is used to position the center rod 3 through the plurality of trunk sections 7. The size and shape of the core portion 11 can vary in different embodiments of the present invention. The plurality of branch sections 12 is radially distributed around the core portion 11 for each of the plurality of trunk sections 7 and is used to attach to the plurality of arm sections 22. Each of the plurality of arm sections 22 is mounted onto one of the plurality of branch sections 12. Since each of the plurality of branch sections 12 is equidistantly positioned radially around the core portion 11, the space between each of the plurality of arm sections 22 also remains consistent. The need for a skilled worker is eliminated with the use of each of the plurality of branch sections 12 that is positioned equidistantly.

Figure 8:
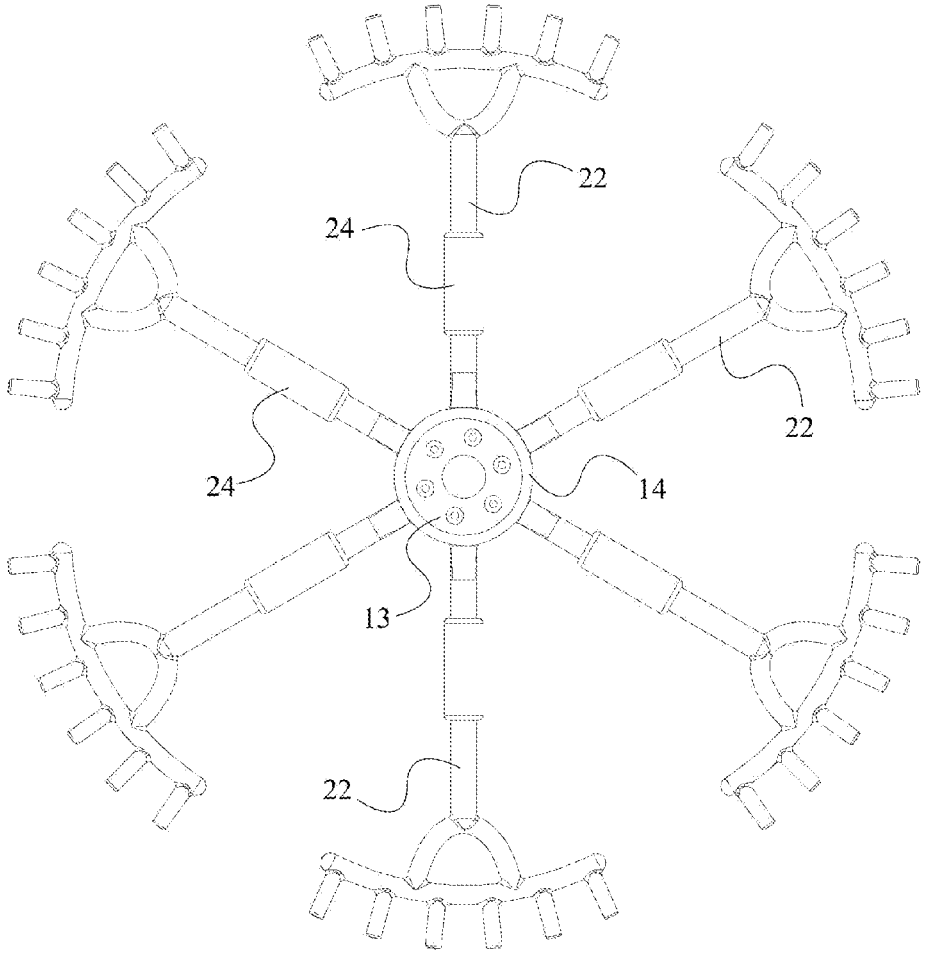
FIG. 8 is a top view of one of the plurality of trunk sections, wherein the plurality of arm sections is removably attached to the plurality of branch sections.
Figure 9:
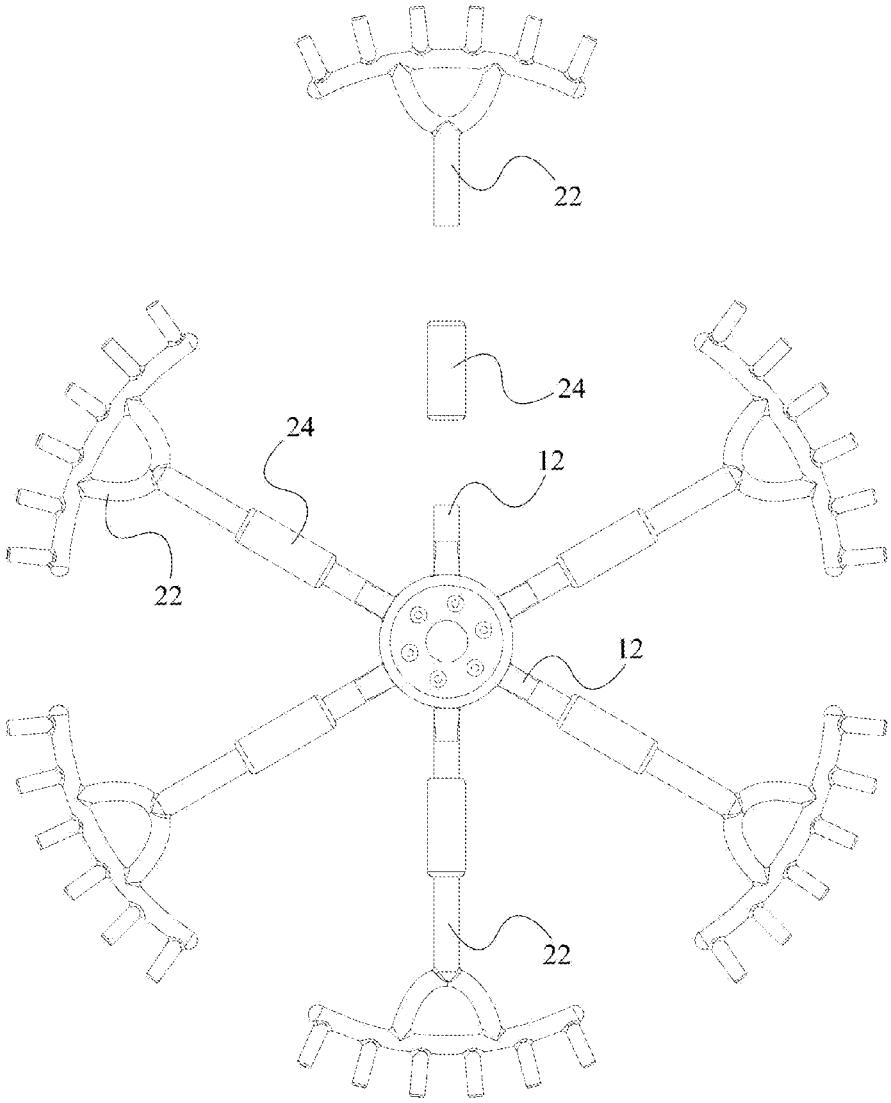
FIG. 9 is an exploded top view of one of the plurality of trunk sections, wherein the plurality of arm sections is removably attached to the plurality of branch sections.
Figure 14:
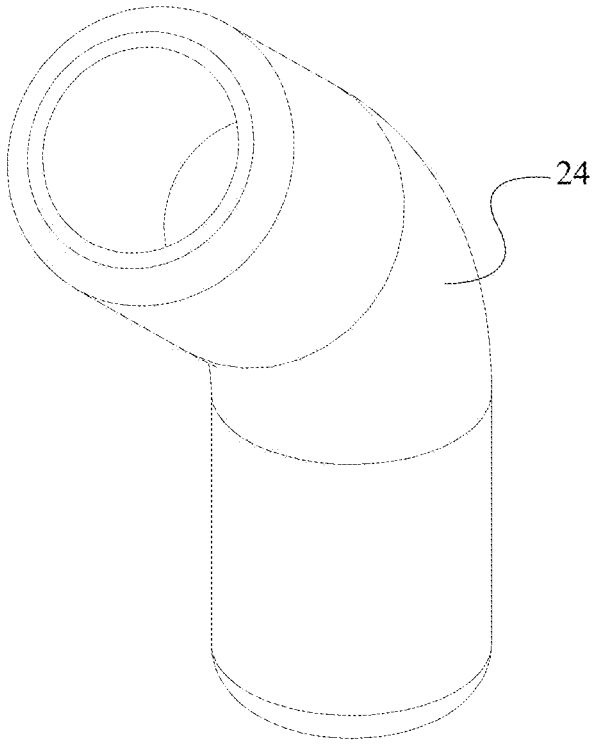
FIG. 14 is a perspective view of an embodiment of one of the plurality of intermediary arm sections.

The plurality of arm sections 22 can be mounted onto one of the plurality of branch sections 12 differently in various embodiments of the present invention. In one embodiment of the present invention, each of the plurality of arm sections 22 can be removably attached to each of the plurality of branch sections 12. As an example, the plurality of arm sections 22 can be removably attached to the plurality of branch sections 12 via a plurality of intermediary arm sections 24 as illustrated in FIG. 8 and FIG. 9. Each of the plurality of intermediary arm sections 24 can be, but is not limited to being a straight tube with two opposite receiving ends. However, the shape and size of the plurality of intermediary arm sections 24 can vary depending on the need of the user. As illustrated in FIG. 14, the shape and size of the plurality of intermediary arm sections 24 can vary in different embodiments. In contrast to being removably attached, the plurality of branch sections 12 can be fixed to one of the plurality of arm sections 22 in another embodiment of the present invention.

As mentioned before, the availability of the plurality of trunk sections 7 allows the user to create a spruing tree of a desired height. When the desired height is achieved, the plurality of trunk sections 7 is locked in place with the end cap 23. More specifically, the end cap 23 is terminally mounted onto the center rod 3 opposite to the plurality of trunk sections 7. Therefore, the plurality of trunk sections 7 is removably secured along the center rod 3 atop the main sprue cone 2 by the end cap 23. If the height of the spruing tree needs to be adjusted, the end cap 23 is unfastened so that the plurality of trunk sections 7 can be accessed and adjusted accordingly.

Each of the plurality of trunk sections 7 is attached together so that the spruing tree remains stable regardless of the height. A top surface 13 and a bottom surface 15 of each of the plurality of trunk sections 7 are used when positioning each of the trunk sections 7 as required. As seen in FIG. 6 and FIG. 7, the top surface 13 and the bottom surface 15 are axially positioned opposite each other. Therefore, each of the trunk sections 7 can be stacked on one another. As in FIG. 3, the top surface 13 of an arbitrary trunk section 8 from the plurality of trunk sections 7 is positioned adjacent the bottom surface 15 of a subsequent trunk section 9 from the plurality of trunk sections 7 so that each of the plurality of trunk sections 7 can be stacked on each other.

To secure each of the plurality of trunk sections 7 in the intended position, the present invention comprises an angular chamfer 14 and a sealing ring 16 as seen in FIG. 6 and FIG. 7. The angular chamfer 14 is peripherally positioned on the top surface 13 of each of the plurality of trunk sections 7. The sealing ring 16 is peripherally positioned at the bottom surface 15 of each of the plurality of trunk sections 7. The angular chamfer 14 and the sealing ring 16 ensure that the bottom surface 15 of the subsequent trunk section 9 lies flush against the top surface 13 of the arbitrary trunk section 8. More specifically, the angular chamfer 14 and the sealing ring 16 prevents the intrusion of investment material into the seams so that the use of softer wax with a lower melting point is permitted.

Figure 10A:
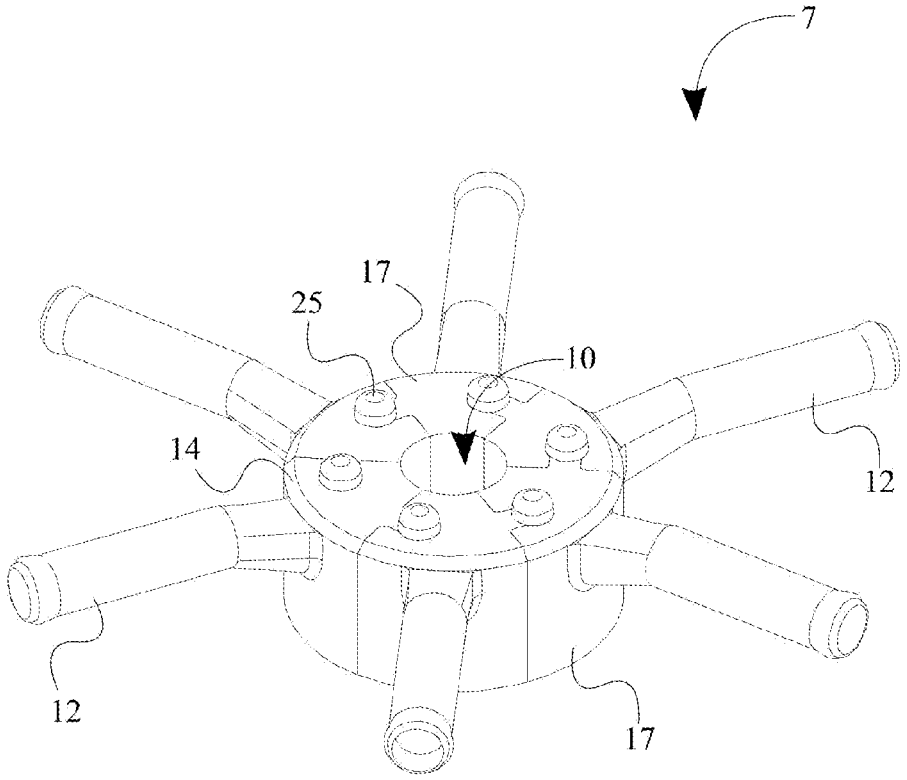
FIG. 10A is a perspective view of one of the plurality of trunk sections, wherein the trunk section comprises a plurality of partitions.
Figure 10B:
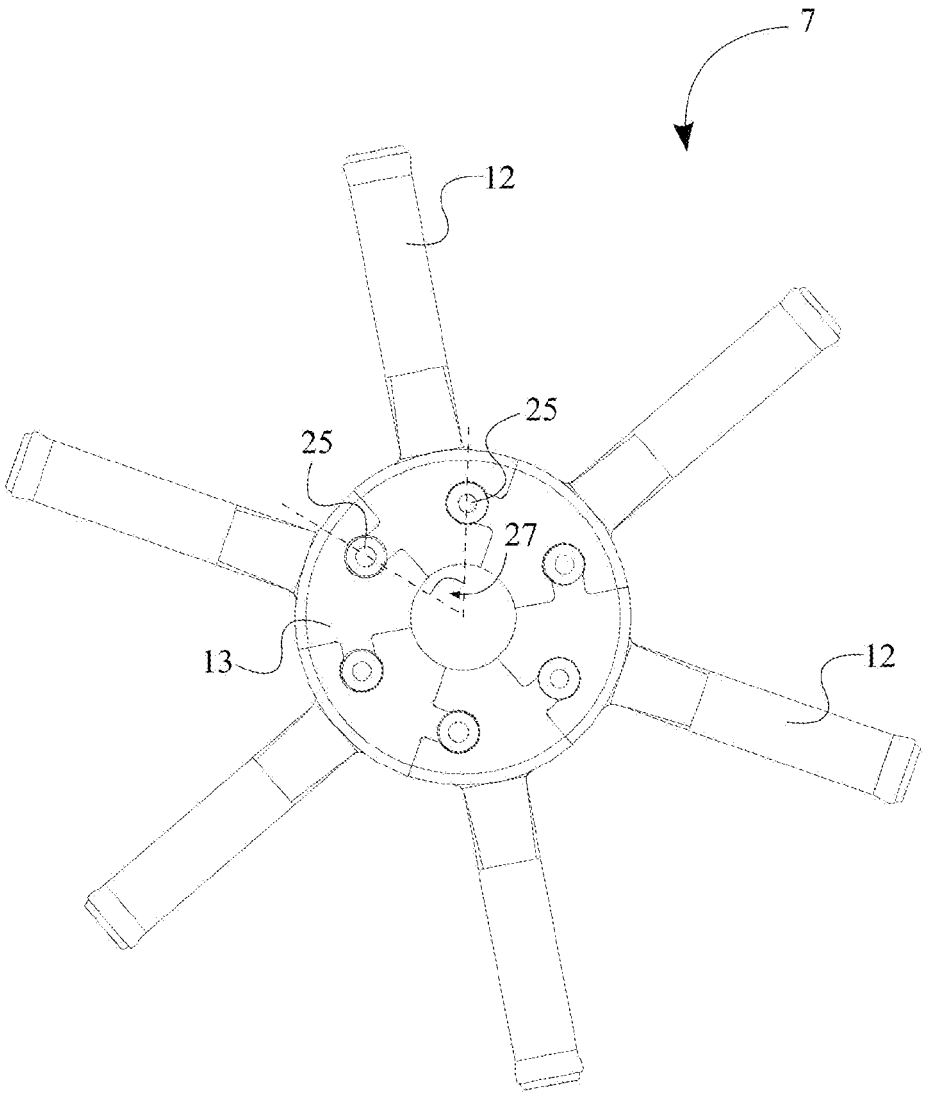
FIG. 10B is a top view of one of the plurality of trunk sections, wherein the trunk section comprises a plurality of partitions.
Figure 11A:
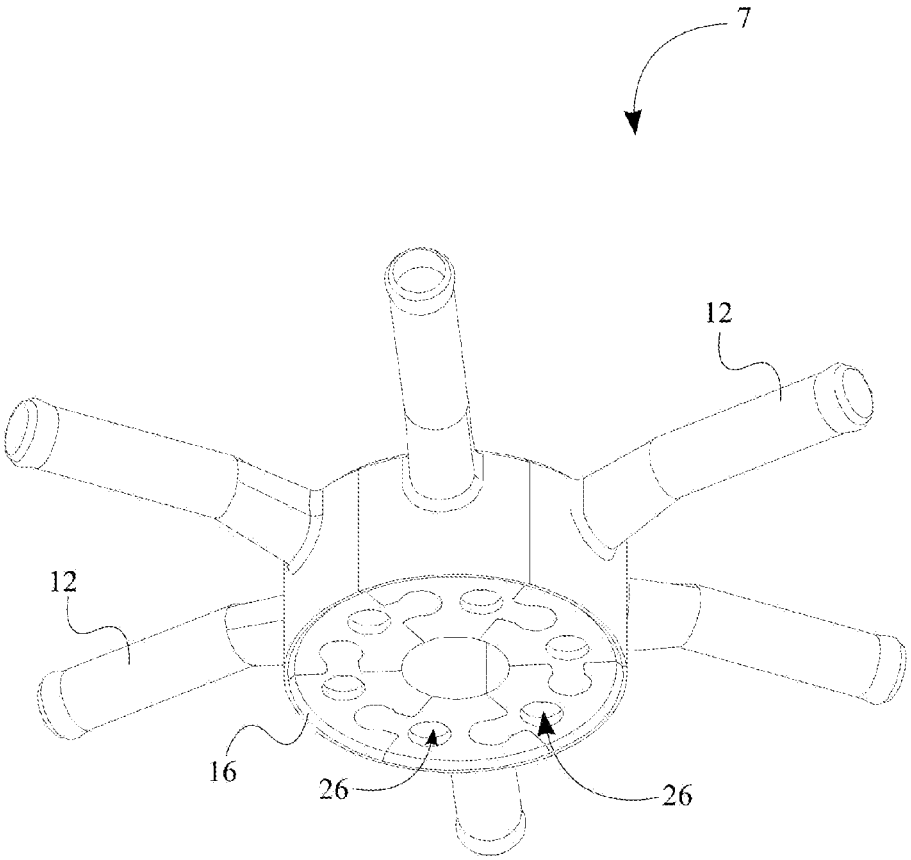
FIG. 11A is a bottom perspective view of one of the plurality of trunk sections, wherein the trunk section comprises a plurality of partitions.
Figure 11B:
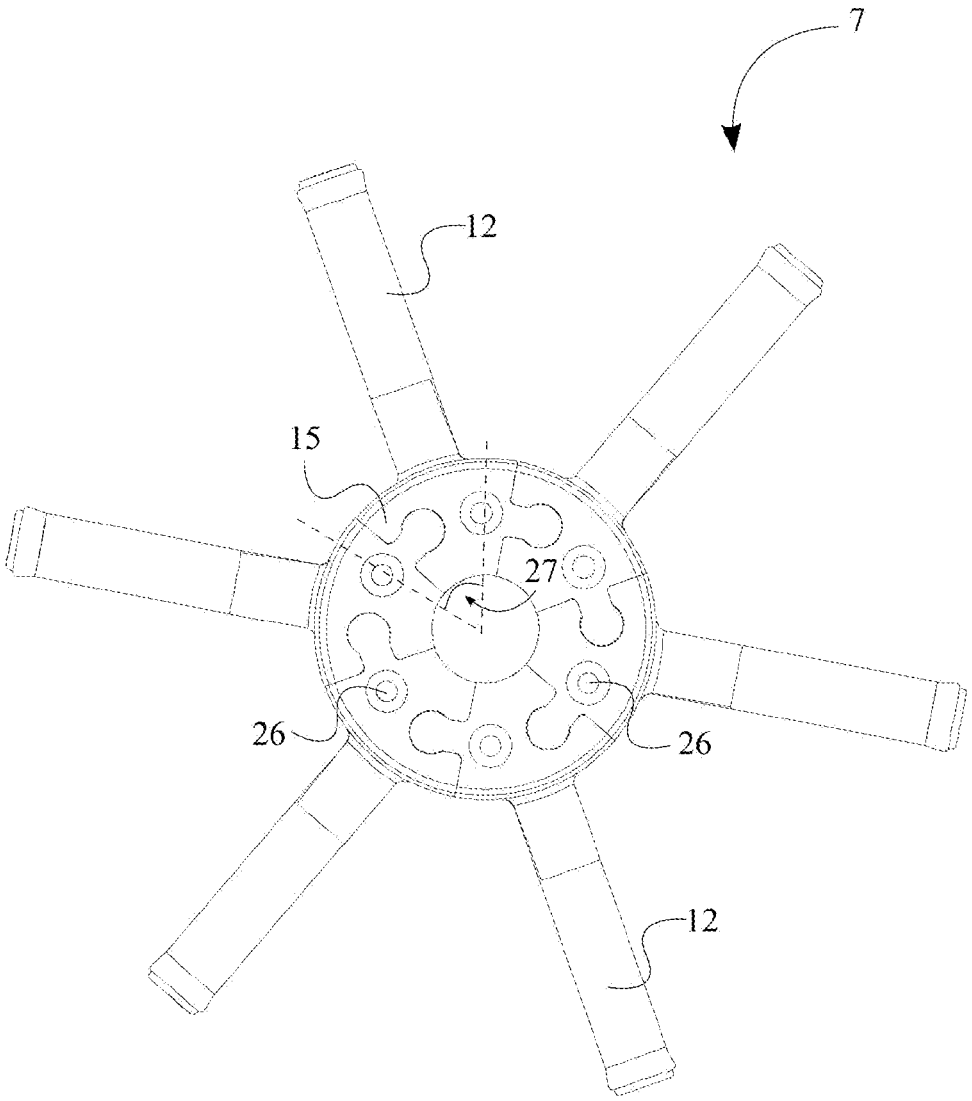
FIG. 11B is a bottom view of one of the plurality of trunk sections, wherein the trunk section comprises a plurality of partitions.

In addition to being pressed against each other, each of the plurality of trunk sections 7 also needs to be attached together. To do so, each of the plurality of trunk sections 7 further comprises a plurality of protrusions 25 and a plurality of receiving holes 26. As shown in FIG. 10A and FIG. 10B, the plurality of protrusions 25 is distributed around the top surface 13 of each of the plurality of trunk sections 7. As illustrated in FIG. 11A and FIG. 11B, the plurality of receiving holes 26 is distributed around the bottom surface 15 of each of the plurality of trunk sections 7. Therefore, when the subsequent trunk section 9 needs to be stacked on the arbitrary trunk section 8, the plurality of protrusions 25 of the arbitrary trunk section 8 is positioned into the plurality of receiving holes 26 of the subsequent trunk section 9. In the preferred embodiment of the present invention, each of the plurality of protrusions 25 is positioned at an acute angle 27 to each other as shown in FIG. 10B. In order to receive the plurality of protrusions 25, each of the plurality of receiving holes 26 is also positioned at an acute angle 27 to each other as shown in FIG. 11B. The acute angle 27 allows the subsequent trunk section 9 to be positioned at different angles so that each of the plurality of arm sections 22 can also be positioned at different angles. Therefore, it is guaranteed that each of the plurality of arm sections 22 receives an equal amount of wax which is essential for consistency. Even though the plurality of protrusions 25 and the plurality of receiving holes 26 are described in this instance, other attachment mechanisms can be used in different embodiments of the present invention.

Figure 12:
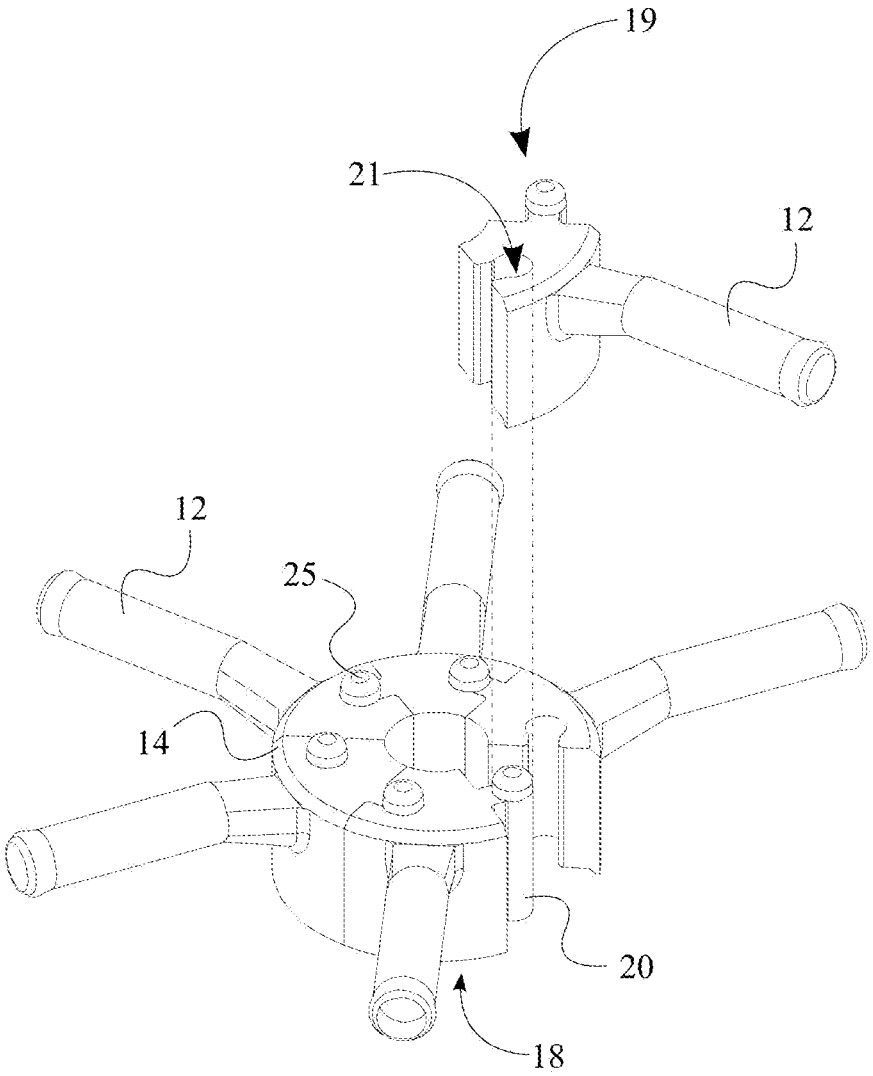
FIG. 12 is a perspective view of one of the plurality of trunk sections, wherein a partition of the plurality of partitions is removed.

The plurality of trunk sections 7 can vary in different embodiments of the present invention. As seen in FIGS. 10A-12, in another embodiment of the present invention, each of the plurality of trunk sections 7 comprises a plurality of partitions 17, wherein each of the plurality of partitions 17 is removably attached to each other. Moreover, each of the plurality of partitions 17 is positioned around the center rod 3 so that the plurality of trunk sections 7 can be used to build the spruing tree. Each of the plurality of partitions 17 interlock at a 60-degree angle so that six partitions make up the plurality of partitions 17. However, the number of partitions can vary in other embodiments of the present invention. The availability of the plurality of partitions 17 allows the plurality of arm sections 22 to be positioned at different vertical positions. The different vertical positions are achieved by slidably engaging each of the plurality of partitions 17 with the use of a tab 20 and a tab receiving channel 21 as seen in FIG. 12. The tab 20 of an arbitrary partition 18 from the plurality of partitions 17 is slidably positioned into the tab receiving channel 21 of a succeeding partition 19 from the plurality of partitions 17. The process is continued so that the plurality of partitions 17 make up the arbitrary trunk section 8 around the center rod 3. Depending on the need of the user, the tab can be positioned at a desired position along the tab receiving channel 21.

Figure 13:
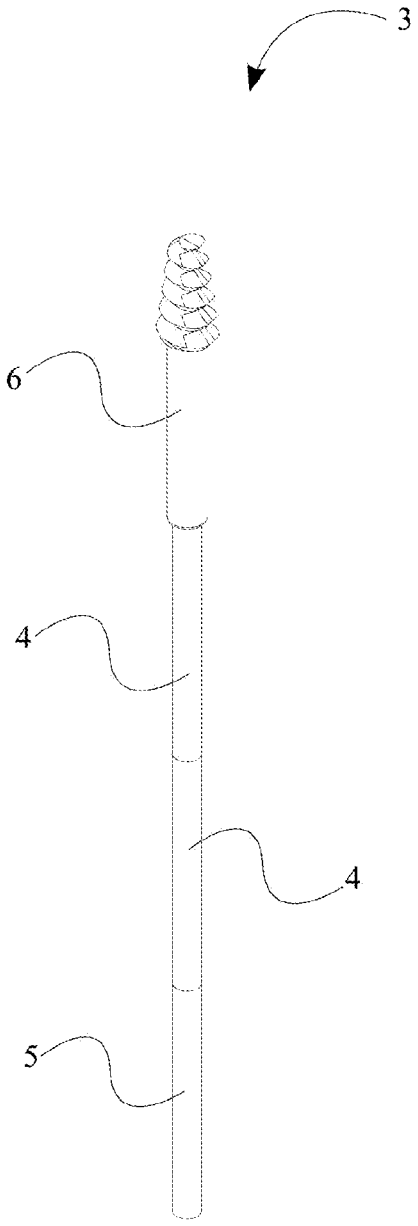
FIG. 13 is a perspective view of the center rod.

As mentioned before, the present invention allows the user to create spruing trees of different heights. To change per the alternating heights of the spruing tree, the center rod 3 comprises a plurality of rod sections 4 as illustrated in FIG. 13. Moreover, each of the plurality of rod sections 4 is removably attached to each other. As an example, if the height of the spruing tree needs to be increased, a new rod section is added to the plurality of rod sections 4. On the other hand, if the height of the spruing tree needs to be shortened, a rod section from the plurality of rod sections 4 is removed. To maintain the stability of the spruing tree, a first rod section 5 of the plurality of rod sections 4 traverses through the base section 1. When the desired height is reached with the plurality of rod sections 4, the end cap 23 is terminally mounted onto a last rod section 6 of the plurality of rod sections 4 opposite to the main sprue cone 2. In the final configuration, the first rod section 5 and the last rod section 6 are positioned opposite to each other along the center rod 3.

As seen in FIG. 3 and FIG. 4, the present invention further comprises a fastening tab 28 which is used along with the end cap 23 to hold the plurality of trunk sections 7 stationary along the center rod 3. By controlling the fastening tab 28, a trunk section can be added to or removed from the plurality of trunk sections 7. For user convenience, the fastening tab 28 is terminally connected to the center rod 3 opposite the end cap 23. Moreover, the fastening tab 28 is positioned adjacent the base section 1 and opposite the main sprue cone 2. By rotating the fastening tab 28 in a clockwise direction or a counter clockwise direction, the user can proceed to control the plurality of trunk sections 7.

Figure 15:
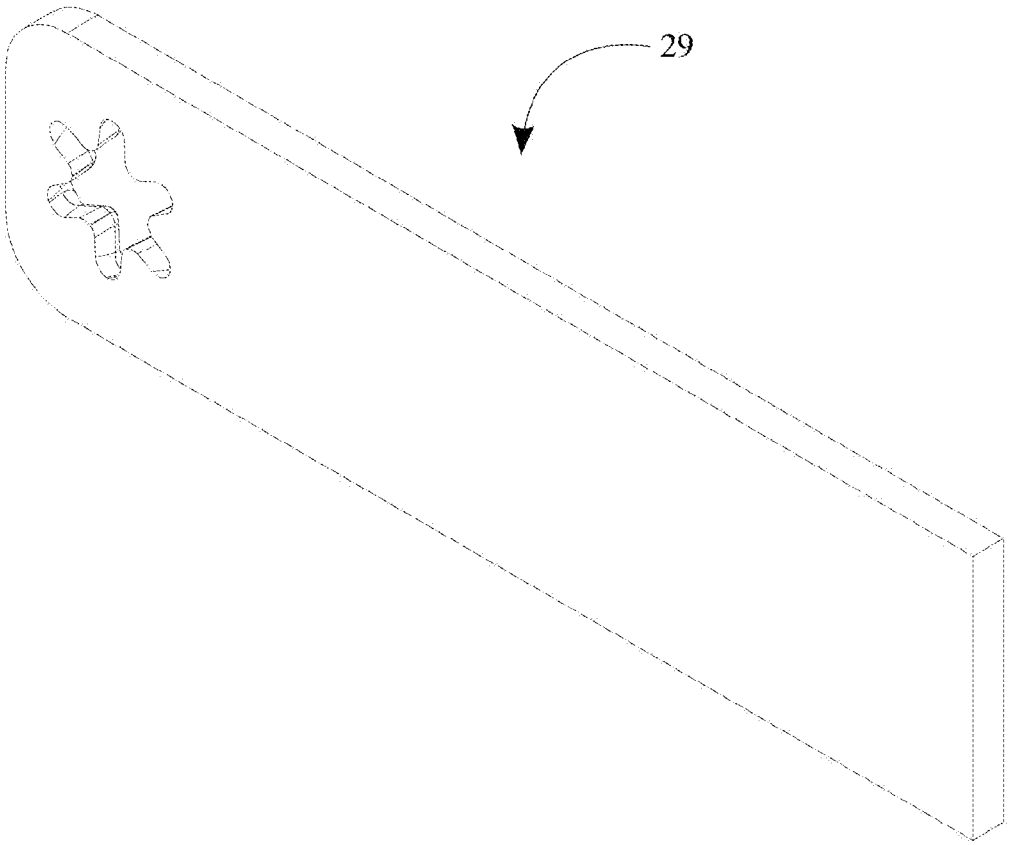
FIG. 15 is a perspective view of the cap wrench.

For user convenience, the present invention further comprises a cap wrench 29. As illustrated in FIG. 15, the cap wrench 29 will be designed to grasp the end cap 23. By utilizing the cap wrench 29, the user can conveniently control the fastening tab 28 as necessary.

When assembling the present invention, the following process flow is generally followed. Initially, the main sprue cone 2 is centrally positioned on the base section 1. Next, the center rod 3 is inserted through the base section 1 and the main sprue cone 2. The fastening tab 28 is terminally connected to the center rod 3 so that the fastening tab 28 is positioned adjacent the base section 1 but opposite the main sprue cone 2. The desired height of the center rod 3 can be adjusted by varying the number of the plurality of rod sections 4. When the desired height is achieved for the center rod 3, the user proceeds to build the spruing tree. The spruing tree can be constructed per user preference within a short time. As an example, each of the plurality of trunk sections 7 can be positioned along the center rod 3 individually by positioning the center rod 3 through the center rod receiving hole 10 of each of the plurality of trunk sections 7. In another instance, the plurality of trunk sections 7 can be stacked together and then the center rod 3 can be inserted through the plurality of trunk sections 7 since the center rod receiving hole 10 of each trunk section is concentrically aligned with each other. When the plurality of protrusions 25 and the plurality of receiving holes 26 are used, the plurality of protrusions 25 is positioned into the plurality of receiving holes 26 for each of the plurality of trunk sections 7. If the plurality of partitions 17 is available, each of the plurality of partitions 17 is removably attached to each other prior to being positioned along the center rod 3. Next, the plurality of arm sections 22 is mounted onto the plurality of branch sections 12. If the plurality of arm sections 22 is removably attached, the plurality of intermediary arm sections 24 is used when attaching the arm sections 22 to the branch sections 12. When the construction of the spruing tree is completed along the center rod 3, the end cap 23 is terminally mounted onto the last rod section 6. The plurality of trunk sections 7 can be locked in position with the use of the end cap 23 and the fastening tab 28. If the user intends on adding or removing a specific trunk section from the plurality of trunk sections 7, the end cap 23 is held and the fastening tab 28 is either rotated in a clockwise direction or a counter clockwise direction.

Although the invention has been explained in relation to its preferred embodiment, it is to be understood that many other possible modifications and variations can be made without departing from the spirit and scope of the invention as hereinafter claimed.

What is claimed is:

1. A modular spruing system comprises:
- a base section;
- a main sprue cone;
- a center rod;
- a plurality of trunk sections;
- a plurality of arm sections;
- an end cap;
- each of the plurality of trunk sections comprises a center rod receiving hole, a core portion, and a plurality of branch sections;
- each of the plurality of trunk sections being removably and concentrically attached to each other;
- the plurality of branch sections is radially distributed around the core section for each of the plurality of trunk sections;
- each of the plurality of arm sections being mounted onto one of the plurality of branch sections;
- the main sprue cone being centrally positioned on the base section;
- the plurality of trunk sections being concentrically positioned adjacent to the main sprue cone opposite the base section;
- the center rod traversing through the base section, the main sprue cone, and the center rod receiving hole of each of the plurality of trunk sections; and
- the end cap being terminally mounted onto the center rod opposite to the plurality of trunk sections, wherein the plurality of trunk sections is removably secured around the center rod atop the main sprue cone by the end cap.

2. The modular spruing system as claimed in claim 1, wherein each of the plurality of arm sections are removably attached to each of the plurality of branch sections.

3. The modular spruing system as claimed in claim 2 further comprises:
- a plurality of intermediary arm sections; and
- the plurality of arm sections being removably attached to the plurality of branch sections via the plurality of intermediary arm sections.

4. The modular spruing system as claimed in claim 1, wherein each of the plurality of branch sections is fixed to one of the plurality of arm sections.

5. The modular spruing system as claimed in claim 1 further comprises:
- each of the plurality of trunk sections comprises a top surface and a bottom surface;
- the top surface and the bottom surface being positioned axially opposite each other on each of the plurality of trunk sections; and the top surface of an arbitrary trunk section from the plurality of trunk sections being positioned adjacent the bottom surface of a subsequent trunk section from the plurality of trunk sections.

6. The modular spruing system as claimed in claim 5 further comprises:

an angular chamfer;

a sealing ring;

the angular chamfer being peripherally positioned on the top surface; and the sealing ring being peripherally positioned at the bottom surface.

7. The modular spruing system as claimed in claim 5 further comprises:

each of the plurality of trunk sections further comprises a plurality of protrusions and a plurality of receiving holes;

the plurality of protrusions being distributed around the top surface of each of the plurality of trunk sections;

the plurality of receiving holes being distributed around the bottom surface of each of the plurality of trunk sections; and the plurality of protrusions being positioned into the plurality of receiving holes.

8. The modular spruing system as claimed in claim 7, wherein each of the plurality of protrusions are positioned at an acute angle to each other.

9. The modular spruing system as claimed in claim 7, wherein each of the plurality of receiving holes are positioned at an acute angle.

10. The modular spruing system as claimed in claim 1 further comprises:

wherein each of the plurality of trunk sections comprises a plurality of partitions;

each of the plurality of partitions being removably attached to each other; and each of the plurality of partitions being positioned around the center rod.

11. The modular spruing system as claimed in claim 10 further comprises:

each of the plurality of partitions comprises a tab and a tab receiving channel; and the tab of an arbitrary partition from the plurality of partitions being slidably positioned into the tab receiving channel of a succeeding partition from the plurality of partitions.

12. The modular spruing system as claimed in claim 1 further comprises:

the center rod comprises a plurality of rod sections;

each of the plurality of rod sections being removably and concentrically attached to each other;

a first rod section of the plurality of rod sections traversing through the base section;

the end cap being terminally mounted onto a last rod section of the plurality of rod sections opposite to the main sprue cone; and the first rod section and the last rod section being positioned opposite to each other along the center rod.

13. The modular spruing system as claimed in claim 1 further comprises:

a fastening tab;

the fastening tab being terminally connected to the center rod opposite the end cap; and the fastening tab being positioned adjacent the base section and opposite the main sprue cone.

* * * * *